US009306349B2

(12) United States Patent
Si

(10) Patent No.: US 9,306,349 B2
(45) Date of Patent: Apr. 5, 2016

(54) CONSTRUCTION OF AN ALTERNATING CURRENT (AC) POWER SOCKET

(71) Applicant: ALLOCACOC CORPORATION, Irvine, CA (US)

(72) Inventor: Khoi Ho Si, Irvine, CA (US)

(73) Assignee: ALLOCACOC CORPORATION, Irvine, CA (US)

( * ) Notice: Subject to any disclaimer, the term of this patent is extended or adjusted under 35 U.S.C. 154(b) by 0 days.

(21) Appl. No.: 14/601,130

(22) Filed: Jan. 20, 2015

(65) Prior Publication Data

US 2015/0207271 A1 Jul. 23, 2015

Related U.S. Application Data

(60) Provisional application No. 61/929,837, filed on Jan. 21, 2014.

(51) Int. Cl.

| | |
|---|---|
| ***H01R 13/648*** | (2006.01) |
| ***H01R 24/78*** | (2011.01) |
| ***H01R 25/00*** | (2006.01) |
| ***H01R 31/02*** | (2006.01) |
| *H01R 43/16* | (2006.01) |

(52) U.S. Cl.
CPC ..... *H01R 24/78* (2013.01); *H01R 25/003* (2013.01); *H01R 31/02* (2013.01); *H01R 43/16* (2013.01)

(58) Field of Classification Search
CPC ..... H01R 24/78; H01R 31/02; H01R 25/003; H01R 13/652; H01R 25/006; H01R 25/16; H02G 3/18; H02G 3/16
USPC ..... 439/92
See application file for complete search history.

(56) References Cited

U.S. PATENT DOCUMENTS

| | | | | |
|---|---|---|---|---|
| 2,994,849 | A * | 8/1961 | Mussari, Jr. | H01R 13/652 439/105 |
| 4,165,443 | A * | 8/1979 | Figart | H02G 3/16 174/53 |
| 4,313,646 | A * | 2/1982 | Millhimes | H01R 31/02 439/215 |
| 4,958,048 | A * | 9/1990 | Bell | H02G 3/18 174/53 |
| 5,383,799 | A * | 1/1995 | Fladung | H01R 25/060 439/108 |
| 7,275,967 | B1 * | 10/2007 | Olliff | H01R 31/02 439/654 |
| 7,648,379 | B2 * | 1/2010 | Johnson | H01R 25/16 439/215 |
| 2010/0022106 | A1 * | 1/2010 | Lee | H01R 25/003 439/92 |

FOREIGN PATENT DOCUMENTS

WO WO-8501394 A1 3/1985

* cited by examiner

*Primary Examiner* — Jean F Duverne
(74) *Attorney, Agent, or Firm* — Nicholson De Vos Webster & Elliott LLP

(57) ABSTRACT

In one embodiment, a current distributing device is disclosed. The current distributing device contains a first current conducting element, a second current conducting element, and a third current conducting element. The three current conducting elements are oriented in or substantially in three orthogonal directions and they are coupled at each direction forming at least one current supply component. Each of the three current conducting elements contains one or more single metal bended sheets without soldering.

20 Claims, 18 Drawing Sheets

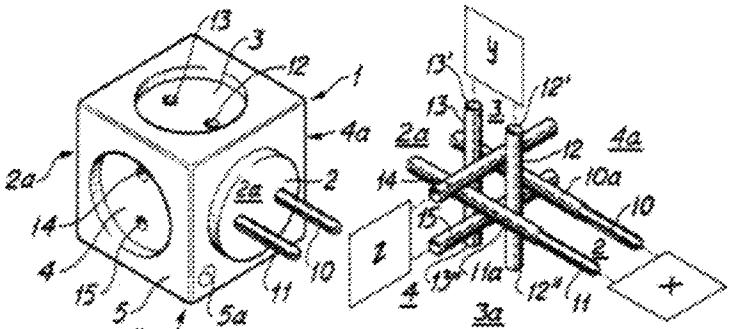
FIG. 1A
FIG. 1B
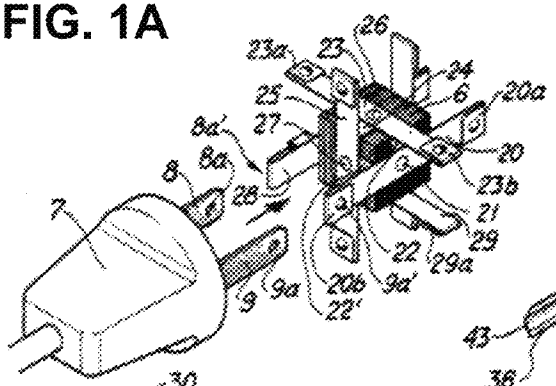
FIG. 1C
FIG. 1D
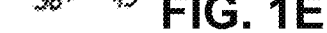
FIG. 1E
FIG. 1F

CONSTRUCTION OF AN ALTERNATING CURRENT (AC) POWER SOCKET

CROSS-REFERENCE TO RELATED APPLICATION

This application claims priority to U.S. Provisional Patent Application No. 61/929,837, filed on Jan. 21, 2014.

FIELD

Embodiments of the invention relate to the field of power socket; and more specifically, to the internal construction of an alternating current (AC) power socket.

BACKGROUND

AC power sockets and power plugs have been a part of people's everyday life for decades. AC power sockets and power plugs are devices that allow electrically operated equipment to be connected to a primary AC power supply. As an AC power socket may contain one or more plug components connecting to a primary AC power supply, an AC power socket as used in this specification may contain one or more functions of a power plug. In other words, an AC power socket in this specification may function as a power plug.

A power socket generally contains two or three electrical conductors for an electrically operated device to connect (usually through a power plug at the electrically operated device side). For a power socket containing three electrical conductors, the three electrical conductors are often referred to as the live conductor, the neutral conductor, and the grounding conductor. For a power socket containing two electrical conductors, the electrical conductors are the live conductor and the neutral conductor. A neutral conductor is usually at or very near to earth potential. A live conductor carries the full supply voltage relative to the neutral, and it is also called a line/phase/hot conductor. A grounding conductor allows the exposed metal parts of the electrically operated device to be connected to earth (known as grounding). The electrical conductors have corresponding receptacles, slots or holes (called female) at the power socket for the electrically operated device to connect through protruding prongs, blades, or pins (called male) of a power plug.

Power sockets may be fixed on a building structure and connected to an energized electrical circuit. These power sockets are often called wall power sockets or wall socket. Power sockets may be mobile and contain one or more plugs to connect to a wall socket, and these power sockets are often called cubical power sockets (or simply cubical sockets) as the shape of such power sockets is often cubical with a square or substantially square shape at six sides of such power sockets. Yet, other shapes for these mobile power sockets are possible. Persons of ordinary skill in the art know that cubical socket may take a different shape other than cubical such as prism and cuboid that contain six sides. The specification refers all such mobile power sockets containing six sides as cubical sockets. It is challenging to build a cubical socket that is compact, economic, and complying with international/national rules/regulation on safety.

SUMMARY

A current distributing device is disclosed. The current distributing device contains a first current conducting element, a second current conducting element, and a third current conducting element. The three current conducting elements are oriented in or substantially in three orthogonal directions and they are coupled at each direction forming at least one current supply component. Each of the three current conducting elements contains one or more single metal bended sheets without soldering.

Without the time consuming and costly process of soldering, the current distributing device according to embodiments of the invention is compact and economic as it concurrently provides multiple power sockets and it is much more efficient in manufacturing.

BRIEF DESCRIPTION OF THE DRAWINGS

The invention may best be understood by referring to the following description and accompanying drawings that are used to illustrate embodiments of the invention. In the drawings:

FIGS. 1A-F illustrate a current distributing device according to a prior art reference.

DESCRIPTION OF EMBODIMENTS

Figure 2:
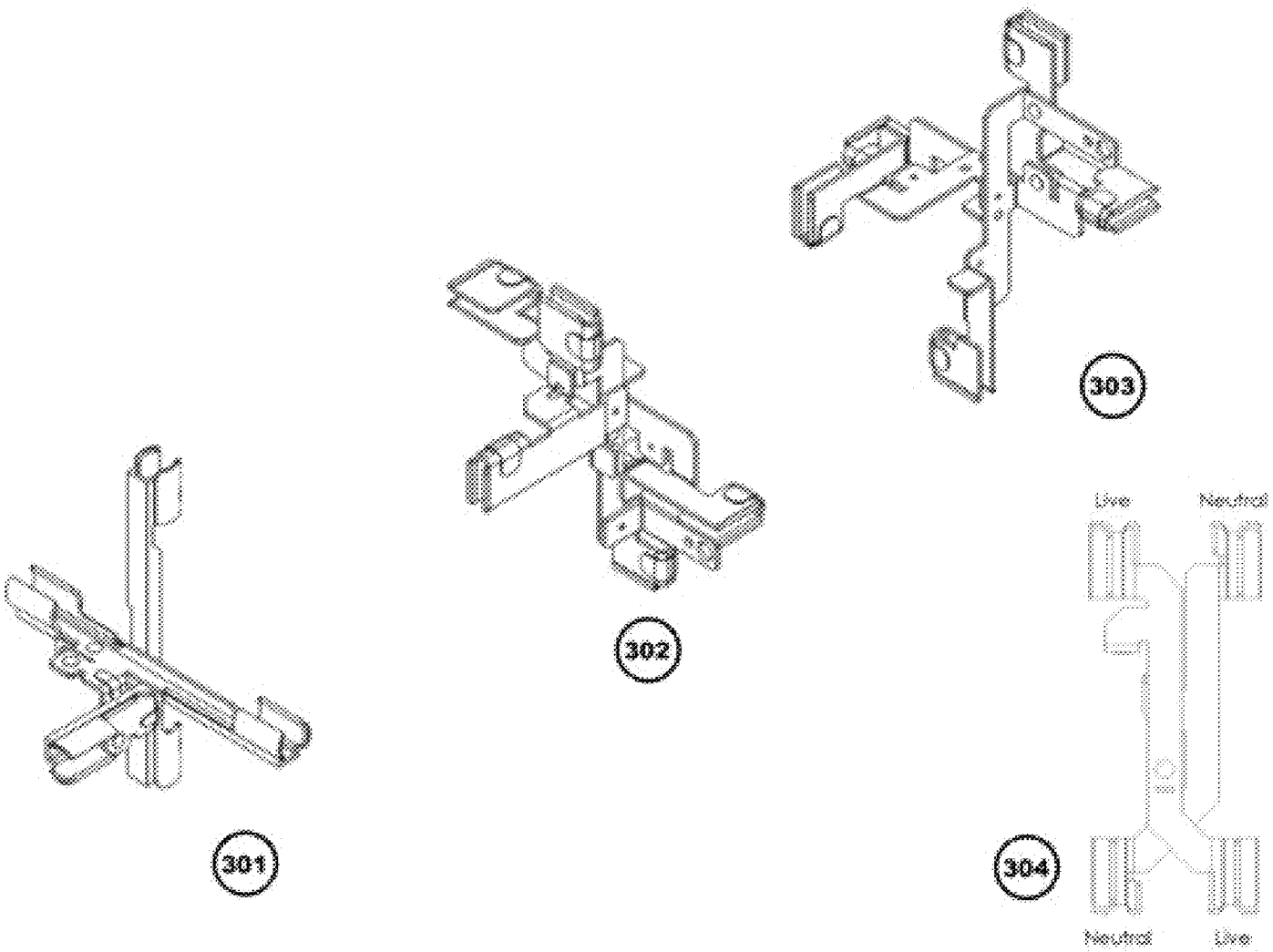
FIG. 2 illustrates three current conducting elements of a current distributing device according to one embodiment of the invention.

In the following description, numerous specific details are set forth. However, it is understood that embodiments of the invention may be practiced without these specific details. In other instances, well-known circuits, structures and techniques have not been shown in detail in order not to obscure the understanding of this description. It will be appreciated, however, by one skilled in the art that the invention may be practiced without such specific details. Those of ordinary skill in the art, with the included descriptions, will be able to implement appropriate functionality without undue experimentation.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

In the following description and claims, the terms "coupled" and "connected," along with their derivatives, may be used. It should be understood that these terms are not intended as synonyms for each other. "Coupled" is used to indicate that two or more elements, which may or may not be in direct physical or electrical contact with each other, cooperate or interact with each other. "Connected" is used to indicate the establishment of communication between two or more elements that are coupled with each other.

A cubical socket may provide many features. For example, a cubical socket may be polarized so that a power plug can only connect to the socket in one way. The electrical polarity ensures that the energized and neutral conductors are not interchanged thus it is safer to use. A cubical socket may also provide on/off switch, Universal Serial Bus (USB) charger, battery, remote control receiver, and surge protections. In addition, a cubical socket often needs to comply with international safety standard and national safety rules/regulations at each nation that the cubical socket is sold. The safety rules/regulations include integration of a circuit breaker and a thermal switch in the cubical socket.

A cubical socket often contains three to five power sockets with one side containing no more than one power socket. Of the six sides of the cubical socket, one side is typically connected to a power supply (through a power plug or a power cable), and each of the other sides is available to accommodate a power socket or other features. When the cubical socket offers other features, the other features often consume one or more sides, and the consumed side may no longer be available to accommodate a power socket.

A cubical socket is currently constructed in several approaches. One approach is to interconnect each conductor of a socket on each side by means of soldering internal wiring, through the center of the power socket. The approach has the advantage of maintaining electrical polarity of each side, and having space for other features such as thermal protector, on/off switch and etc. However, it is difficult to solder manually up to 15 connections and short cables within the limited space of a cubical socket, thus it is time consuming and cost to construct a cubical socket this way.

Another approach is to interconnect each conductor of the socket on each side by means of soldering internal wiring or metal conductors, around the front and backside of the cube. Yet the drawback is that it is space consuming and leaves no space for additional features that are required by safety standard and national safety rules/regulations such as a thermal protector or an on/off switch. Neither has it had space for additional power socket related features, such as a remote controlled switch, Internet through power line, and etc. In addition, with this approach, it is difficult to maintain electrical polarity, because all the socket receptacles need to be aligned to one side.

Another approach is to interconnect each conductor of the socket on each side by means of metal sheet through the center of the cubical socket. FIGS. 1A-F illustrate the known construction of a cubical socket. While this approach is popular in the prior art, it does not comply with international safety standard of maintaining the electrical polarity (live and neutral) of each power socket.

Yet another approach is to interconnect each conductor of the sockets on each side by means of lengthened receptacle through the center of the cubical socket, and joined together with a massive clot of soldering. This approach may solve the cost problem with efficient and quick assembly, however it is against the international safety regulations to join more than two metal plates/parts under a big clot of soldering. This approach also has the issue of maintaining only minimal creeping distance between the conducting parts.

Since none of the prior approaches offer a solution that is compact, economic, and complying with international/national rules/regulation on safety, a better solution is needed.

FIG. 2 illustrates three current conducting elements of a current distributing device according to one embodiment of the invention. The current distributing device is a cubical socket in one embodiment, and the cubical socket contains three conducting elements: a neutral conducting element, a live conducting element, and a grounding conducting element, which can be referred to as a neutral conductor group, a live conductor group, and a grounding conductor group respectively. As illustrated, reference 301 is a grounding conductor group, reference 302 is a live conductor group, and reference 303 is a neutral conductor group respectively. Reference 304 illustrates that a neutral conductor group and a live conductor group are crossed over. As discussed in more detail herein below, each conductor group contains one or more conductors, where each conductor is for a power socket at one side of the cubical socket. The crossover is asymmetrically crisscrossed to the other side in one embodiment. The goal is to maintain the polarity of the live and neutral receptacle components on the other side of the cubical socket. Note the reference numbers are unique throughout the figures and the specification, and the same reference numbers in the figures and the specification refer to the same entity.

Note the cubical socket has six sides, and each side may contain one power socket. The power socket of one side contains a socket receptacle (or simply referred to as receptacle), which has two or three receptacle components. Each receptacle component is a slot, or a hole of the socket receptacle. When the receptacle contains three components, the three components (referred to as neutral component, live component, and neutral component of the receptacle) corresponds to a neutral conductor of the neutral conductor group, a live conductor of the live conductor group, and a grounding conductor of the grounding conductor group respectively, and an electrically operated device may connect to the receptacle with a power plug using three protruding prongs, blades, or pins. When the receptacle contains only two components, the two components corresponds to a neutral conductor and a live conductor, and the electrically operated device may connect to the receptacle with a power plug using two protruding prongs, blades, or pins. Also note that while the illustrated cubical socket contains three conductors, it may only provide two receptacle components for one or more sides of the power sockets, in which case the grounding conductor is hidden from being available for an electrically operated device to use.

Figure 3:
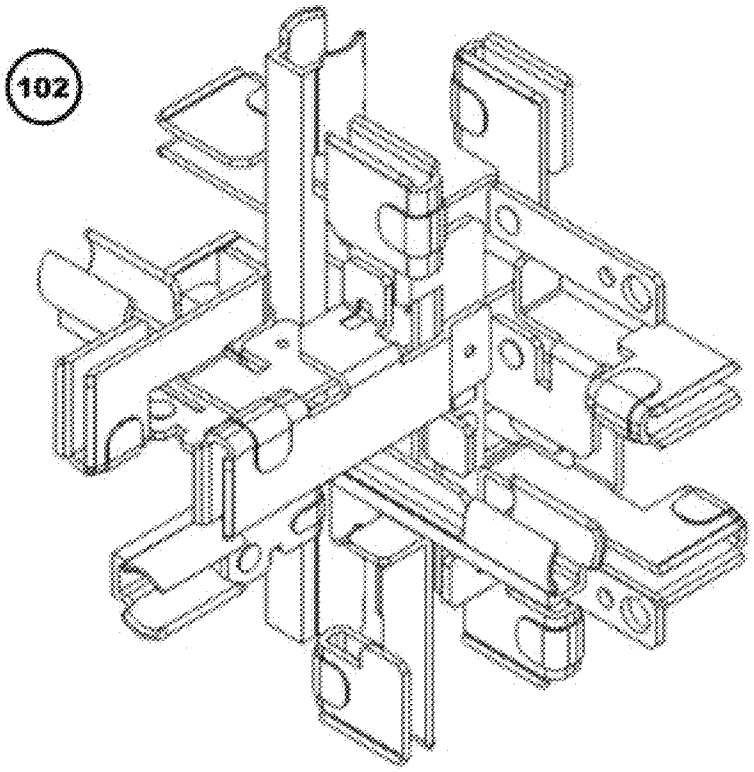
FIG. 3 illustrates internal view of a current distributing device according to one embodiment of the invention.

FIG. 3 illustrates internal view of a current distributing device according to one embodiment of the invention. The assembly at reference 102 is an integration of the neutral conductor group, the live conductor group, and the grounding conductor group of FIG. 2 in one embodiment. Note that the three conductor groups are crisscrossed each other and make up a power socket at each of the six directions of the cubical socket. In each direction, the power socket contains a neutral conducting component, a live conducting component, and a grounding component to form a neutral receptacle component, a live receptacle component, and a grounding receptacle component respectively.

Figure 4:
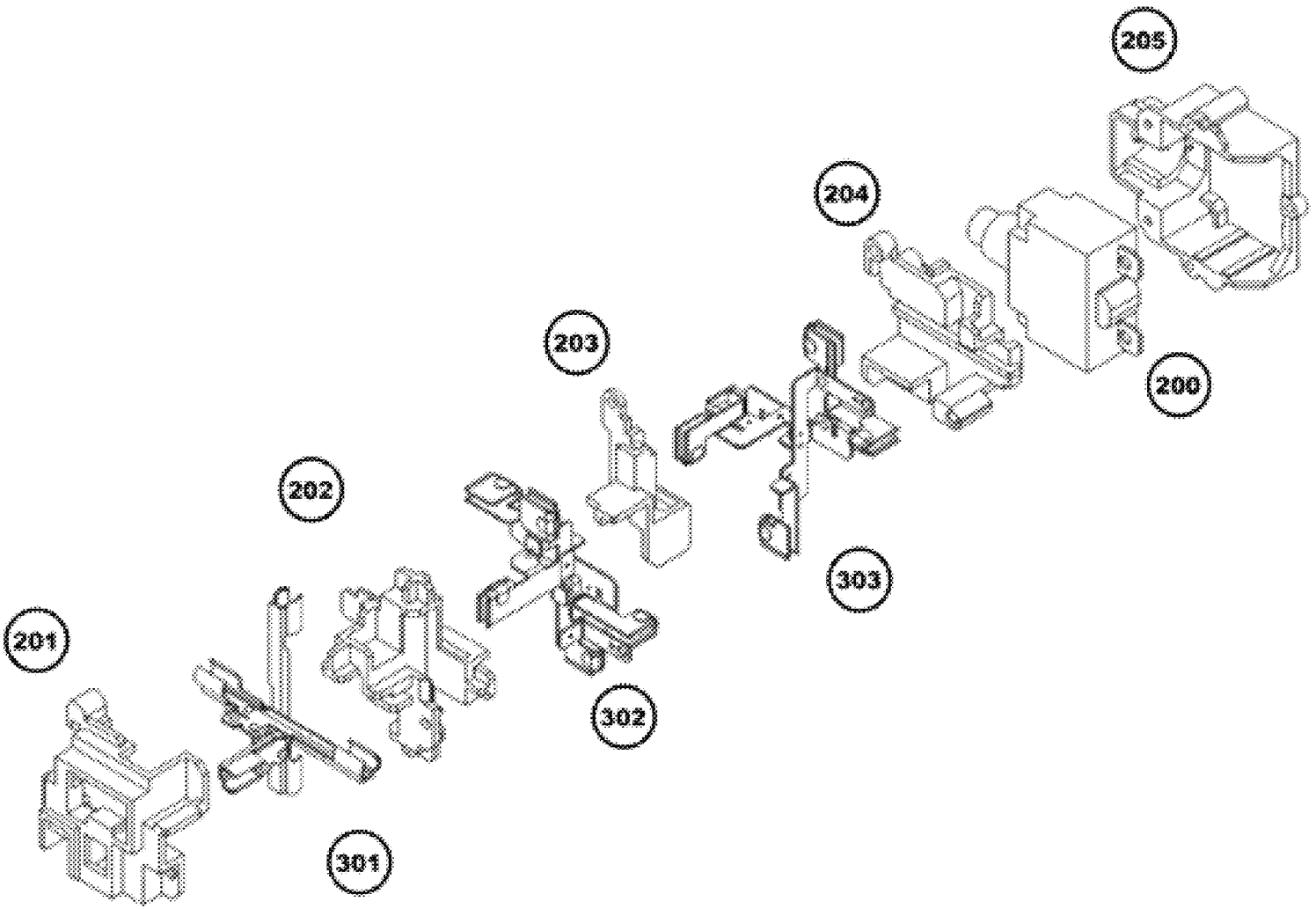
FIG. 4 illustrates main elements of a current distributing device according to one embodiment of the invention.

FIG. 4 illustrates main elements of a current distributing device according to one embodiment of the invention. The current distributing device, a cubical socket, includes grounding conductor group 301, live conductor group 302, and neutral conductor group 303. In addition, it includes non-metal elements such as circuit breaker 200 and isolation fixtures 201, 202, 203, 204 and 205. The circuit breaker 200 is an electrical switch designed to protect electrical circuits formed during operation of the cubical socket from damages caused by overload or short circuit. The circuit breaker 200 may detect a fault condition and interrupt current flow. The circuit breaker may be reset to resume normal operation. The isolation fixture holds the three conductors, and they provide isolation from electricity. The isolation fixture may be made of plastic but other isolating materials work well too.

Figure 5:
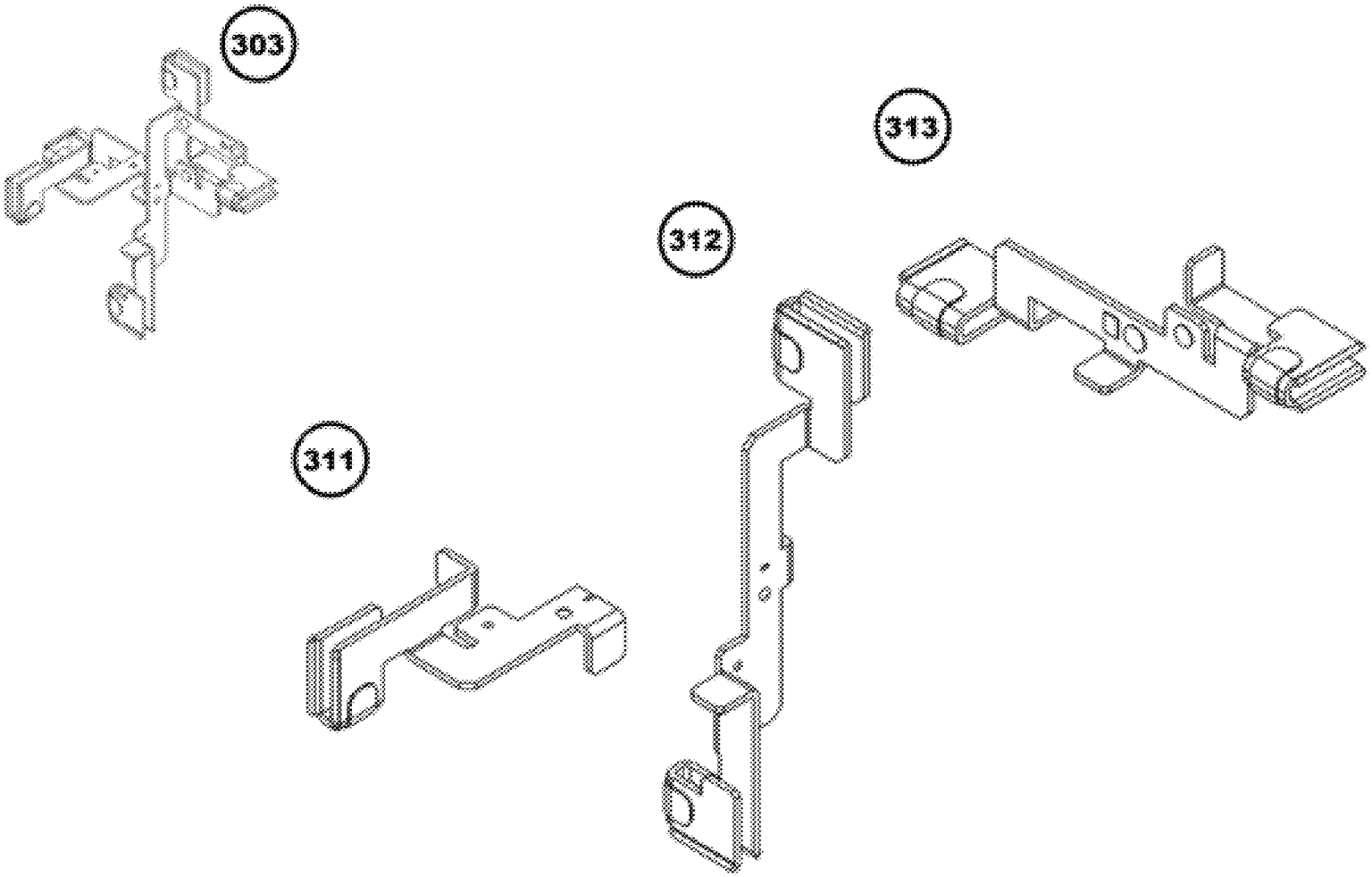
FIG. 5 illustrates a neutral conducting element of a current distributing device according to one embodiment of the invention.

FIG. 5 illustrates a neutral conducting element of a current distributing device according to one embodiment of the invention. The neutral conducting element is neutral conductor group 303, which is illustrated at the top left corner of the figure. The neutral conductor group 303 is an assembly that can be separated into three parts, which are welded together.

The three parts of the neutral conductor group 303 are neutral conductors 311, 312, and 313, which are in the identical shape in one embodiment. The identical shaped neutral conductors are identical metal sheet units in one embodiment. Because they are identical, the investment in tooling is significantly lower than otherwise. Machined sheet welding is a more reliable connection method than soldering done manually by hand, which can become loose after a certain period of time. The embodiment of the invention thus offers a better quality of product. In addition, machined sheet welding is faster than soldering or wiring, resulting in lower assembly time/costs.

Also, a neutral conductor such as neutral conductor 311 (assuming it is the front conductor of a cubical socket) can be cut in half in order to create space for necessary components like a thermal protector at the opposite side (the back side of the cubical socket).

In addition, neutral conductor group 303 may contain only two neutral conductors to create space for some features requiring a larger space (e.g., an on/off switch) in the cubical socket. With the neutral conductor group being formed of modulated neutral conductors, it is easier to produce a variety of different design for a cubical socket.

Figure 6:
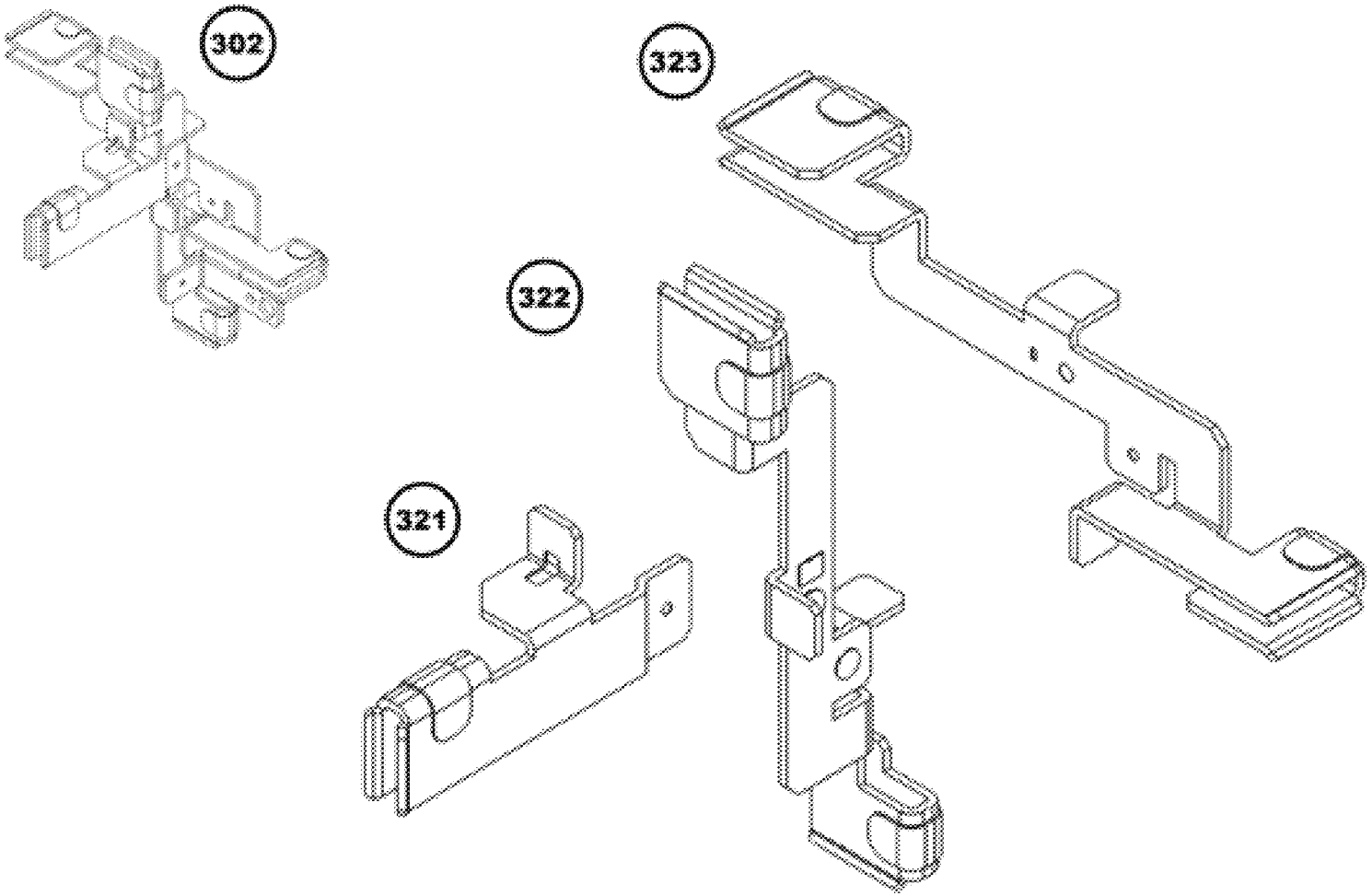
FIG. 6 illustrates a live conducting element of a current distributing device according to one embodiment of the invention.

FIG. 6 illustrates a live conducting element of a current distributing device according to one embodiment of the invention. The live conducting element is live conductor group 302, which is illustrated at the top left corner of the figure. The live conductor group 302 is an assembly that can be separated into three parts, which are welded together.

The three parts of the live conductor group 302 are live conductors 321, 322, and 323 respectively. In one embodiment, live conductors 322 and 323 are in the identical shape of neutral conductors 311, 312, and 313 illustrated in FIG. 5. The live conductor 321 is in a different shape in one embodiment in order to comply with electrical isolation distance requirement according to national/international safety rules and regulations. In that case, live conductor 321 is a metal sheet unit made separately.

Figure 7:
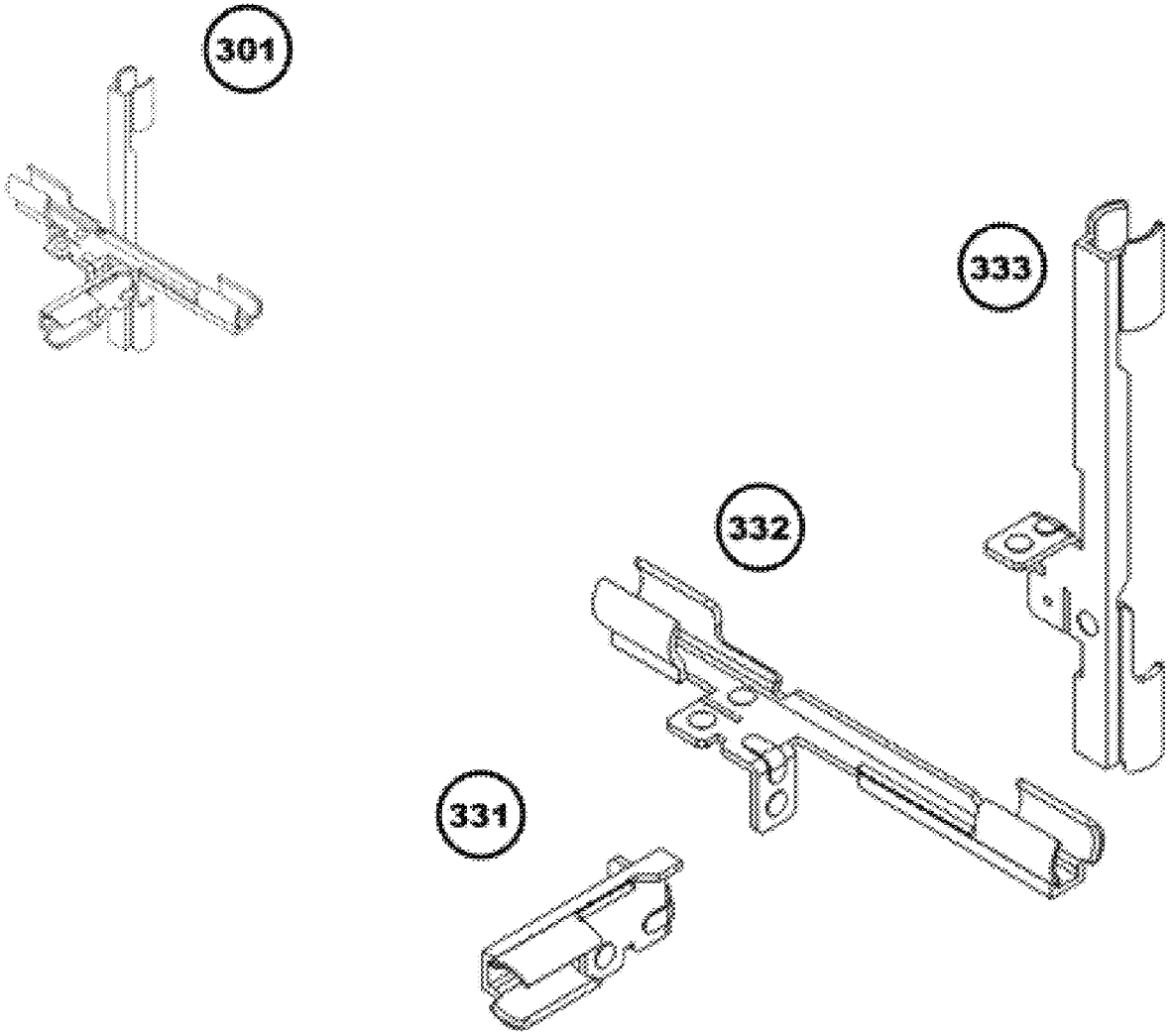
FIG. 7 illustrates a grounding conducting element of a current distributing device according to one embodiment of the invention.

FIG. 7 illustrates a grounding conducting element of a current distributing device according to one embodiment of the invention. The grounding conducting element is grounding conductor group 301, which is illustrated at the top left corner of the figure. The grounding conductor group 301 is an assembly that can be separated into three parts, which are welded together.

The three parts of the grounding conductor group 301 are grounding conductor 331, 332, and 333 respectively. In one embodiment, grounding conductor 331, 332, and 332 are in the identical shape of each other, and they can be welded together. In one embodiment, to save space in one direction (e.g., front of a cubical packet), one grounding conductor (331 as illustrated) is cut in half. In another embodiment, to save more space, the grounding conductor group 301 may contain only two grounding conductors such as illustrated at 332 and 333.

Figure 8:
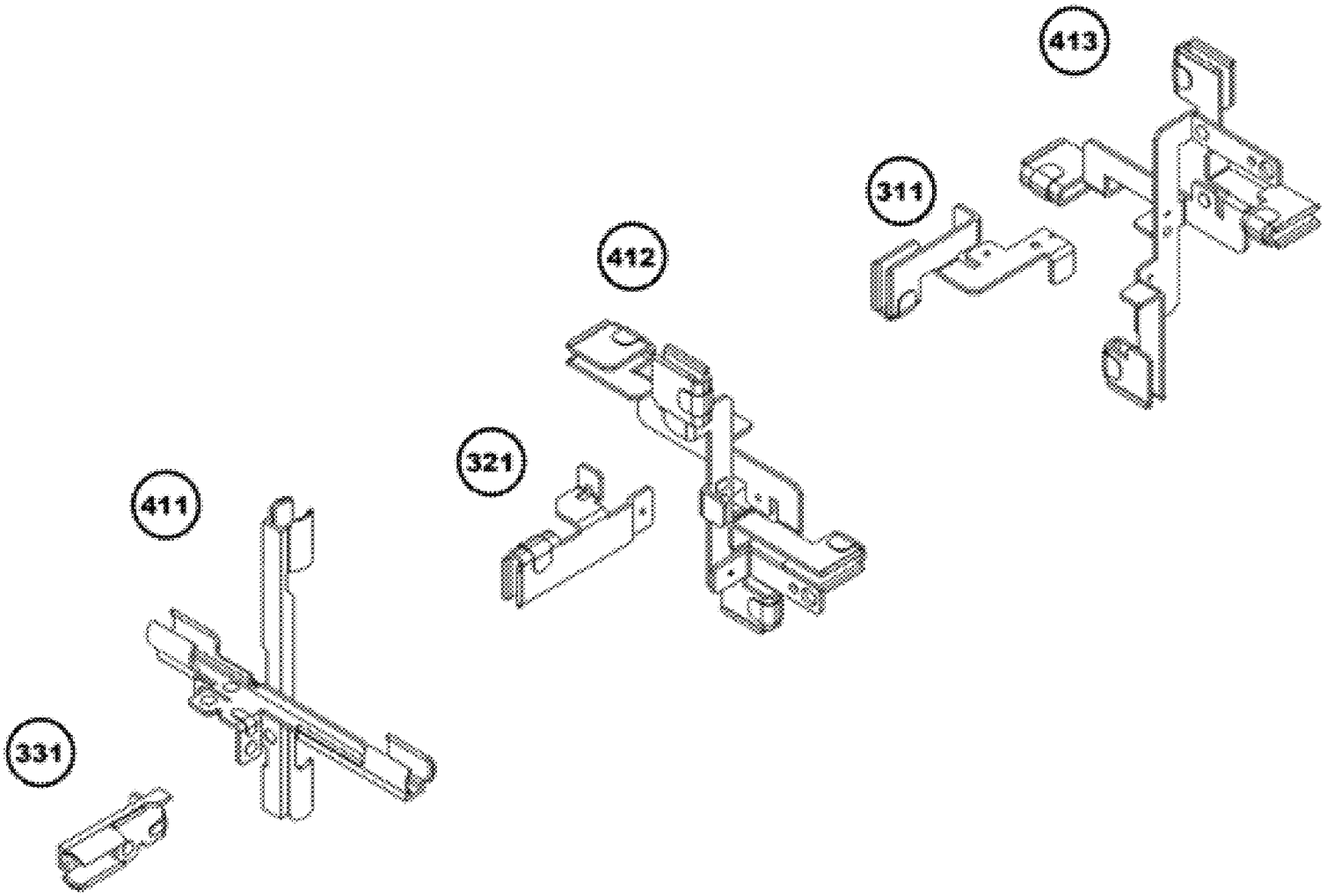
FIG. 8 illustrates removing current conducting elements from a current distributing device according to one embodiment of the invention.

FIG. 8 illustrates removing current conducting element from a current distributing device according to one embodiment of the invention. While a current distributing device may be assembled together using current conducting groups 301, 302, and 303 as illustrated in FIG. 2, the current distributing device may also be assembled using current conducting group 411, 412, and 413 as illustrated in FIG. 8. Note that neutral conductor group 413 and neutral conductor 311 in combination would form neutral conductor group 303, live conductor group 412 and live conductor 321 in combination would form live conductor group 302, and grounding conductor group 411 and grounding conductor 331 in combination would form grounding conductor group 331. The conductors 311, 321, and 331 are removed to create more space for providing other features at the cubical socket—for example, USB charging, on/off switch, remote controlled switch receiver, and etc. The removal will remove a power socket having receptacle corresponding to neutral conductor 311, live conductor 321, and grounding conductor 331. However, the removal of the conductors will neither compromise the functionality of the remaining socket sides, nor lose benefits of efficient design for manufacturing the conductors.

Figure 9:
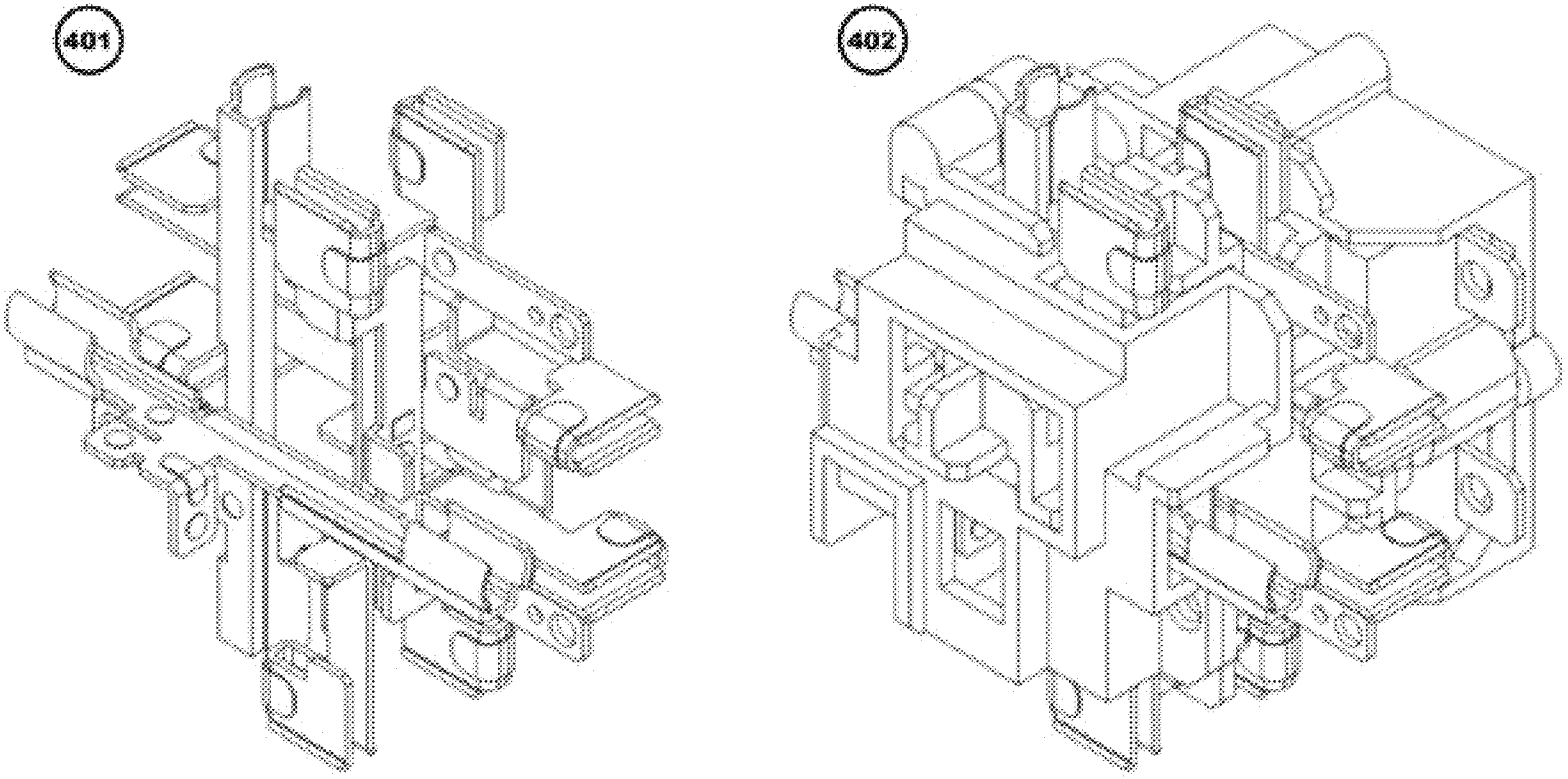
FIG. 9 illustrates assembly of a current distributing device without a front side socket according to one embodiment of the invention.

FIG. 9 illustrates assembly of a current distributing device without a front side socket according to one embodiment of the invention. The current distributing device is a cubical socket, and two views of the cubical socket is illustrated. On the left of the figure is the core of conductor groups 401 without front side conductors. As illustrated in FIG. 8, neutral conductor group 413, live conductor group 412, and grounding conductor group 411 may form the core of a cubical socket without front side conductors, which would form front side socket with corresponding receptacle. On the right of the figure is the core of the conductor groups 402 without front side conductors and with non-metal isolation fixtures.

Figure 10:
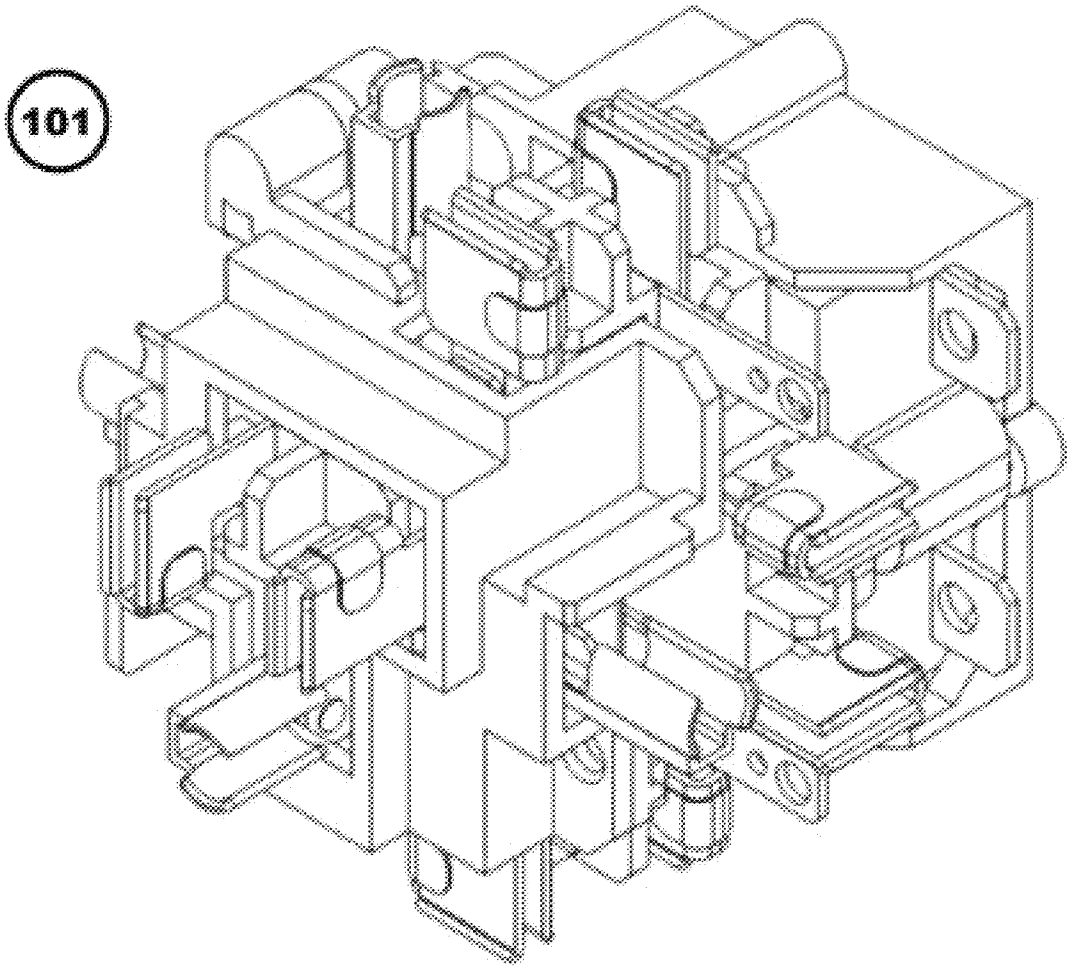
FIG. 10 illustrates an assembled core of a current distributing device according to one embodiment of the invention.

FIG. 10 illustrates an assembled core of a current distributing device according to one embodiment of the invention. The current distributing device is a cubical socket, and it contains non-metal isolation fixtures and neutral, live, and grounding conductor groups as discussed herein above. In the assembly, a circuit breaker for thermal overload protection may be integrated at the back of the assembly. The conductor groups go through the center of the cubical socket while maintaining the electrical polarity of the live and neutral conductor at each side. The core is a standalone subassembly, which makes it modularly compatible with different cubical power socket designs that have different features or types of sockets.

Figure 11:
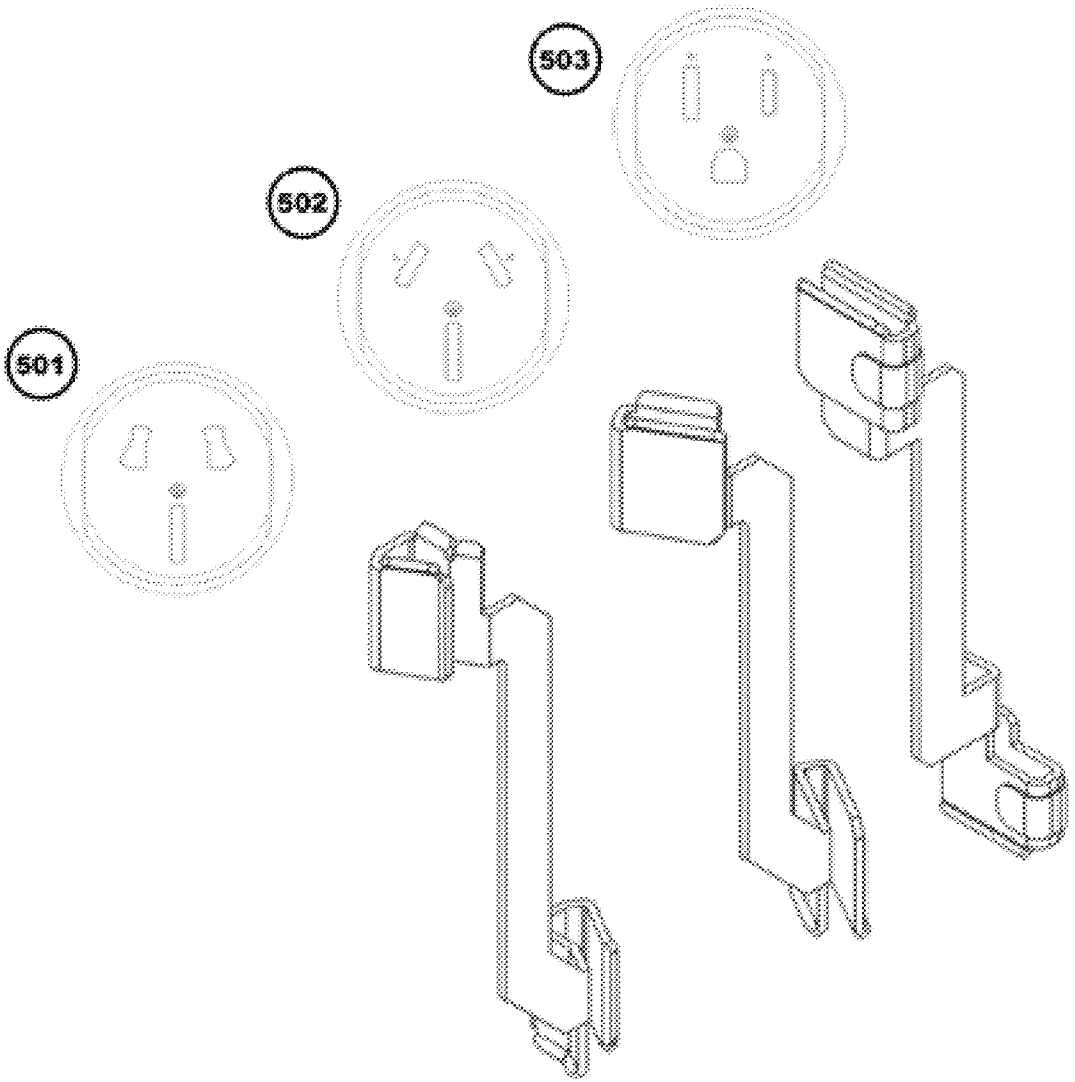
FIG. 11 illustrates a variety of socket receptacles of a current distributing device according to one embodiment of the invention.

FIG. 11 illustrates a variety of socket receptacles of a current distributing device according to one embodiment of the invention. There are many different plug and socket standards in the world. With a small twist of pin-clamp at both end of the metal sheet unit, the socket receptacle can be made compatible for different types of plugs and sockets. Reference 501 points to receptacles compatible with the standard of United States of America. Reference 502 points to receptacles compatible with the standard of Australia, and reference 503 points to receptacles, which is a combination of 502 and 503 types of socket, and they are used in countries like China where two standards are used simultaneously.

Figure 12:
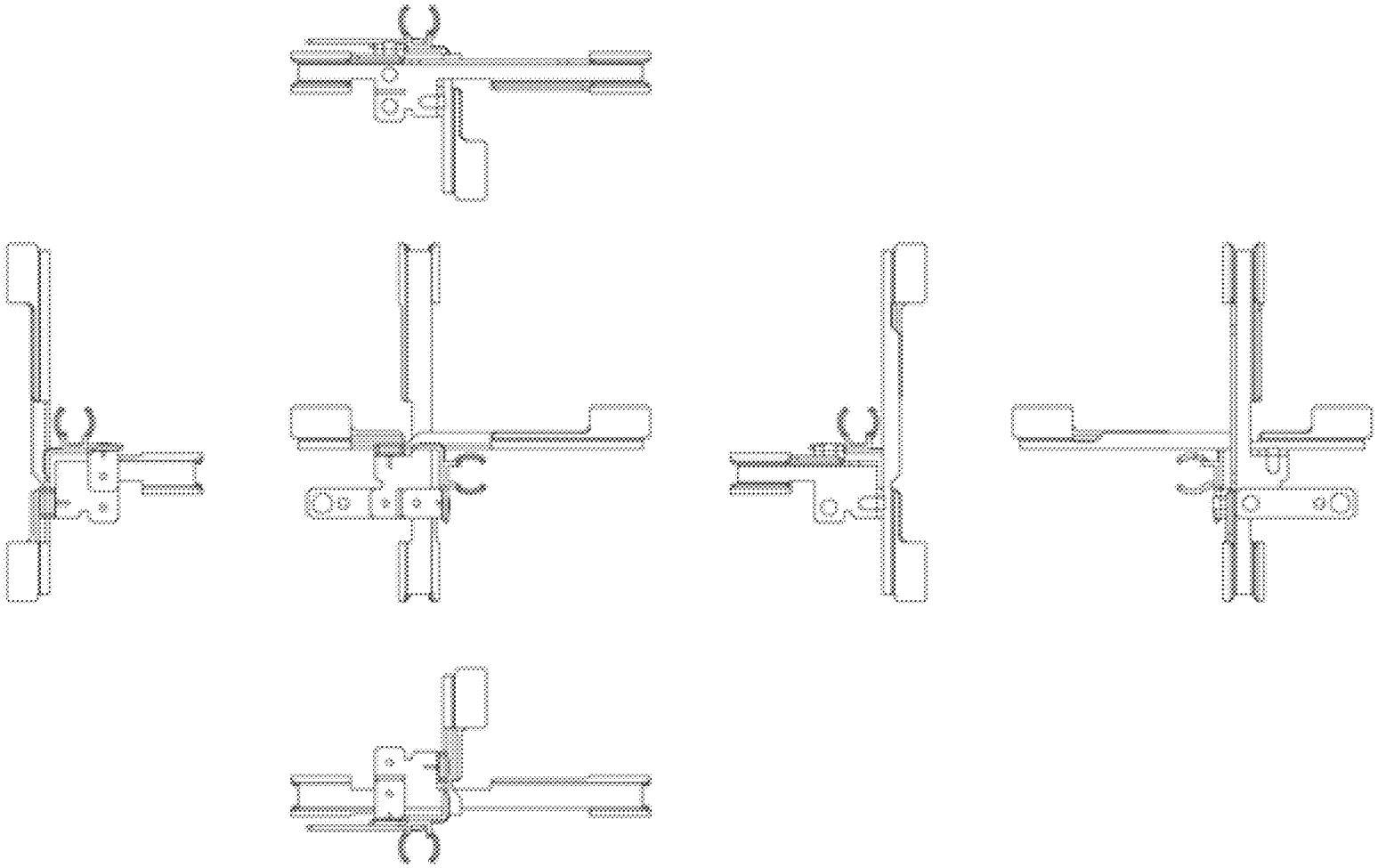
FIG. 12 illustrates views of a neutral conducting element of a current distributing device according to one embodiment of the invention.
Figure 13:
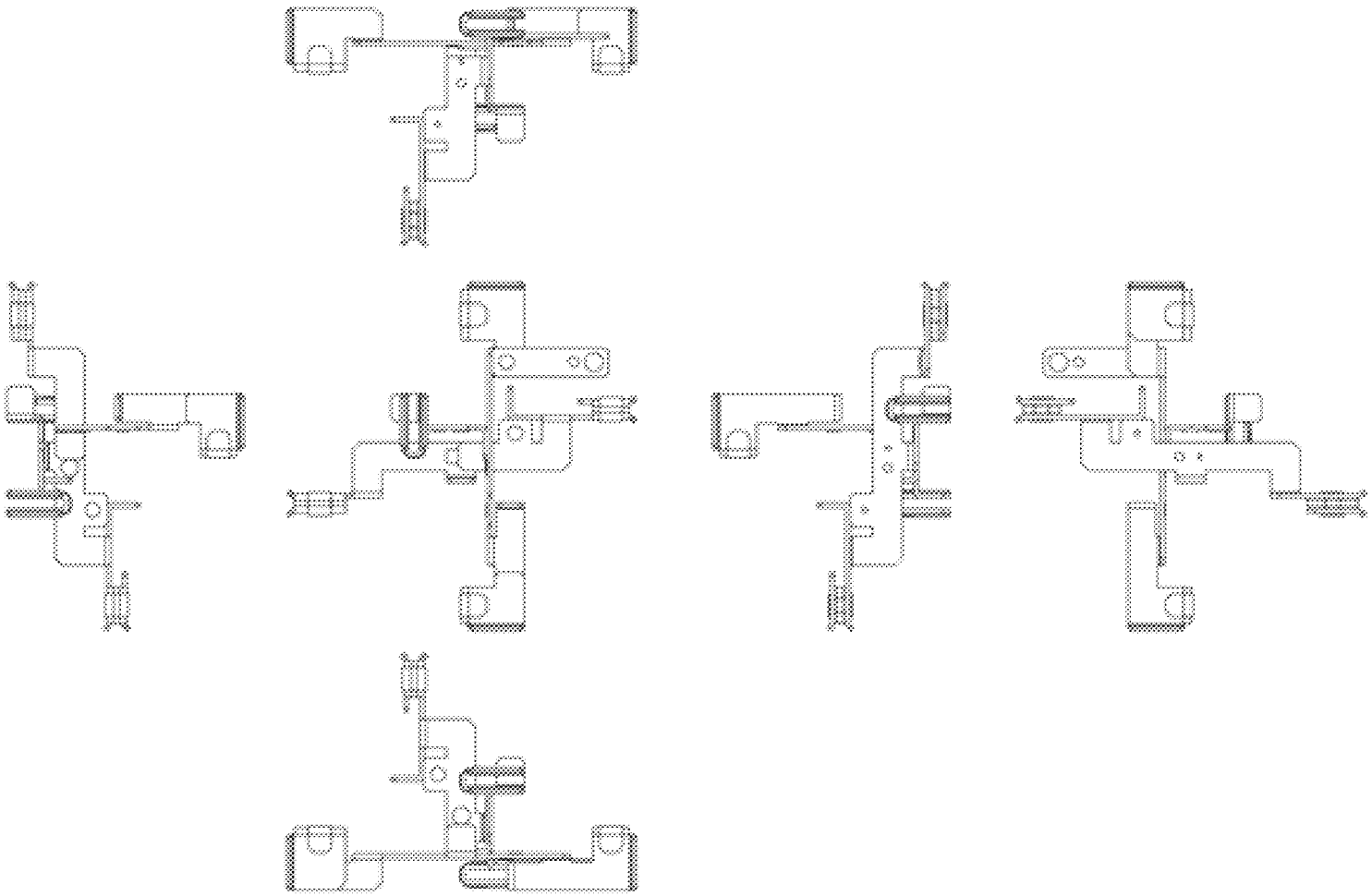
FIG. 13 illustrates views of a live conducting element of a current distributing device according to one embodiment of the invention.
Figure 14:
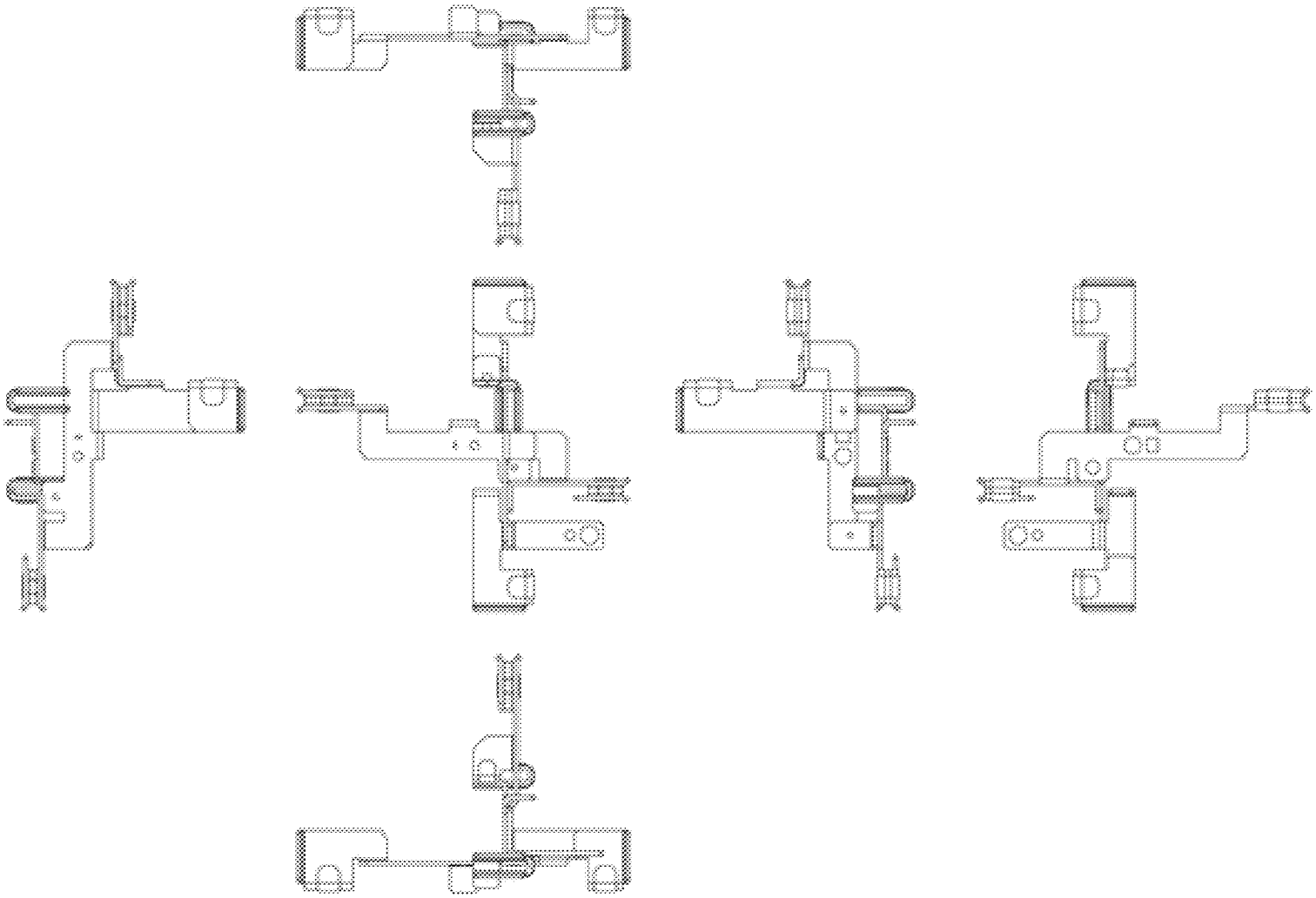
FIG. 14 illustrates views of a grounding conducting element of a current distributing device according to one embodiment of the invention.

FIGS. 12, 13, and 14 illustrate views of a neutral conducting element, a live conducting element, and a grounding conducting element of a current distributing device respectively according to one embodiment of the invention. The views are front, back, left, right, top and bottom views.

Figure 15:
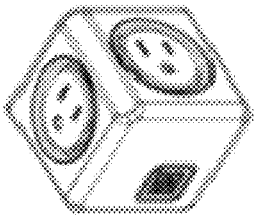
FIG. 15 illustrates external views of a first current distributing device according to one embodiment of the invention.
Figure 15:
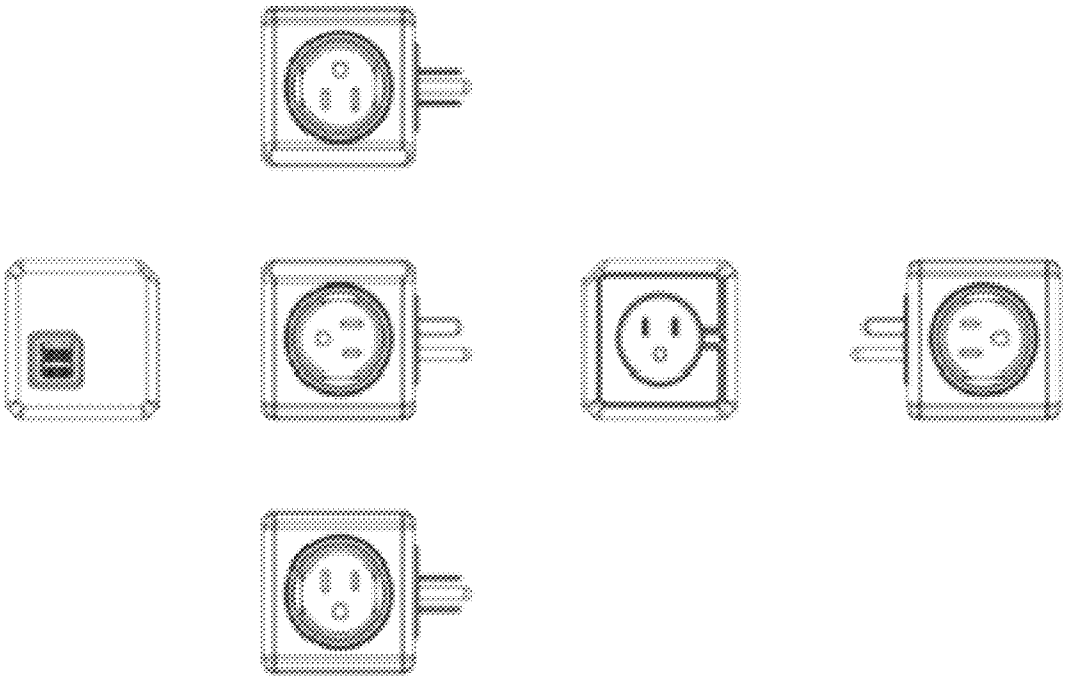

FIG. 15 illustrates external views of a first current distributing device according to one embodiment of the invention. The current distributing device is a cubical socket. It contains four power sockets at four sides, each side has one power socket. At the two remaining sides, one contains a USB charging port, and the other contains a power plug for plugging to another power socket. Note the side containing the USB charging port may correspond to the front side of the core of a cubical socket illustrated in FIG. 9. In an alternative embodiment, the side containing the USB charger is replaced by a side containing another power socket. Or the side may be replaced by a side containing another feature, such as an on/off switch or a thermal protector.

Figure 16:
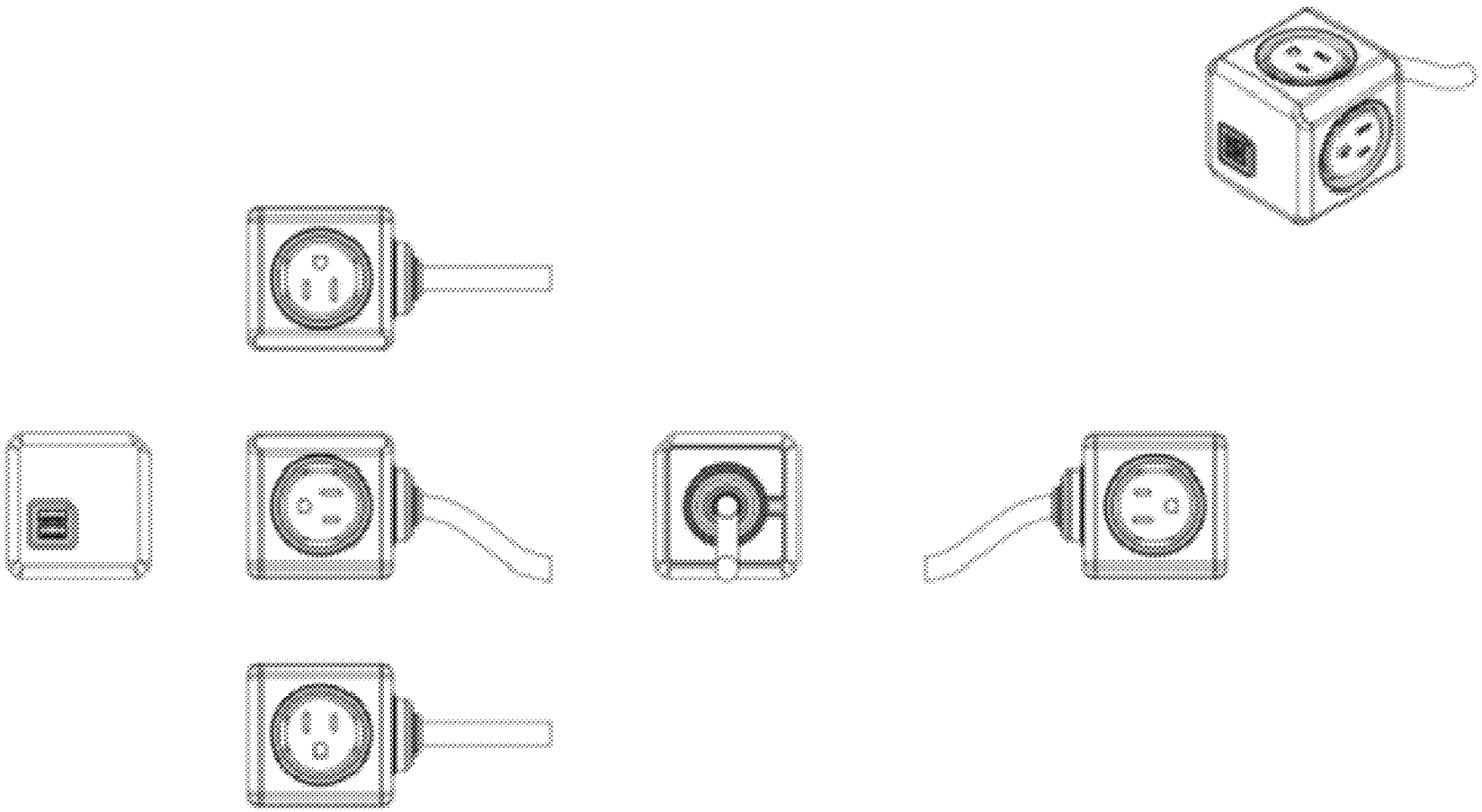
FIG. 16 illustrates external views of a second current distributing device according to one embodiment of the invention.

FIG. 16 illustrates external views of a second current distributing device according to one embodiment of the invention. The current distributing device is a cubical socket again. It again contains four power socket at four sides, each side has one power socket. At the two remaining side, one contains a USB charging port, which may be replaced by another power socket or other features as discussed above. The difference is that at the remaining side, instead of a power plug, it contains a power cord connecting to somewhere (e.g., a plug). That is, it may be further away from a power socket than the cubical socket illustrated in FIG. 15.

Figure 17:
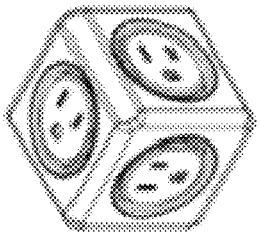
FIG. 17 illustrates external views of a third current distributing device according to one embodiment of the invention.
Figure 17:
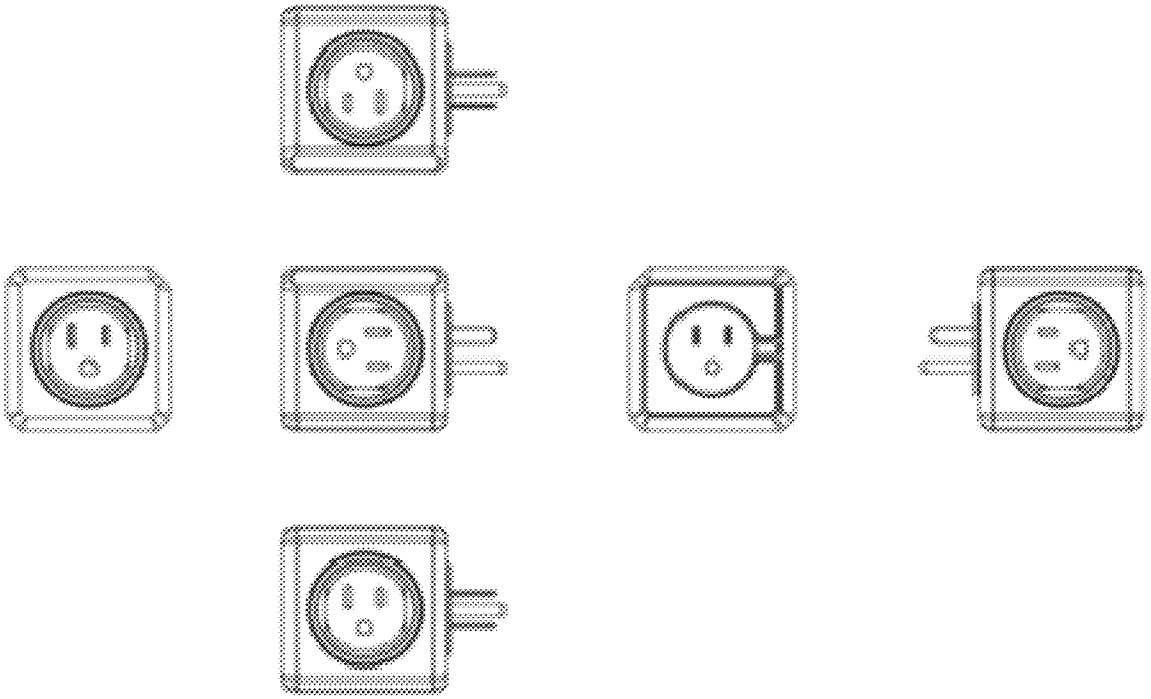

FIG. 17 illustrates external views of a third current distributing device according to one embodiment of the invention. FIG. 17 is similar to FIG. 15 with the exception that the side containing the USB charger in FIG. 15 is replaced by a side containing a power socket.

Figure 18:
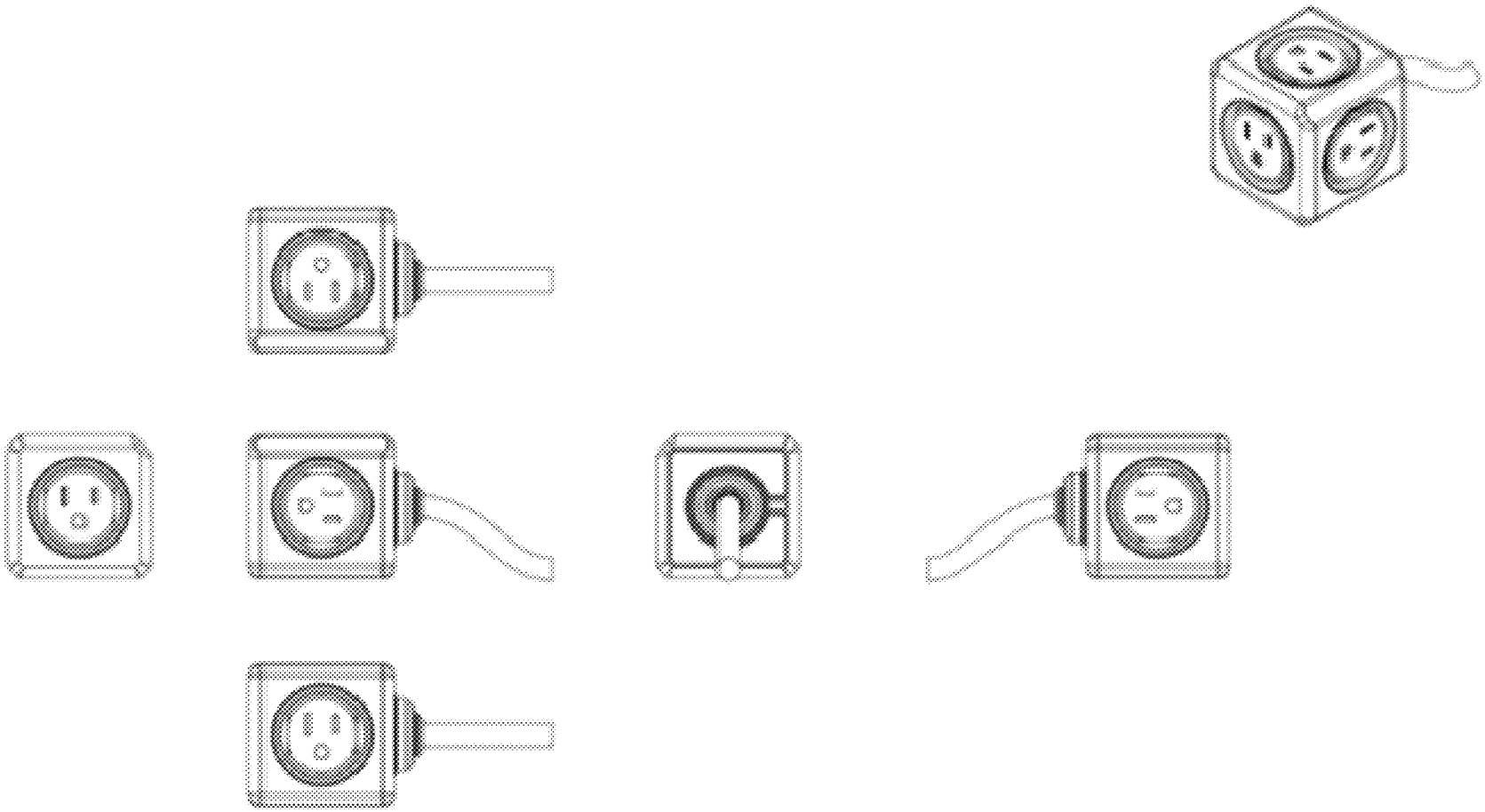
FIG. 18 illustrates external views of a fourth current distributing device according to one embodiment of the invention.

FIG. 18 illustrates external views of a third current distributing device according to one embodiment of the invention. FIG. 18 is similar to FIG. 16 with the exception that the side containing the USB charger in FIG. 16 is replaced by a side containing a power socket.

Note that the non-metal (e.g., plastic) casing may be similar in all four current distributing devices.

The embodiments of the invention offer a number of benefits. For example, as the connecting construction (the neutral, the live, and the grounding conducting groups) goes directly through the center of the product without using wiring and cables in some embodiments, it may result in less material and less parts being used. It may be more compact too as the connecting construction goes directly through the center of the product, which creates space for other features. Because the three conducting groups comprises bended metal sheets, and they are enclosed in non-metal fixture, they can be easily inserted in the core of a cubical socket without manual soldering of additional electrical conductors. With the bended metal sheets being welded parts, not through soldering, they have a better stability and less likely come loose, thus resulting in better quality of cubical socket. The embodiments of the invention can also be made to comply with national/international safety standards for electrical conductors (e.g., the ones concerning polarity issue of live and neutral conductors).

While the invention has been described in terms of several embodiments, those skilled in the art will recognize that the invention is not limited to the embodiments described, can be practiced with modification and alteration within the spirit and scope of the appended claims. The description is thus to be regarded as illustrative instead of limiting.

What is claimed is:

1. A current distributing device comprising:

a first current conducting element, a second current conducting element, and a third current conducting element, wherein the three current conducting elements are oriented in or substantially in three orthogonal directions, wherein the three current conducting elements are coupled at each of the three orthogonal directions, forming at least one current supply component at each of the three orthogonal directions, wherein the at least one current supply component at each of the three orthogonal directions is a power socket, and wherein each of the three current conducting elements contains one or more single metal bended sheets without soldering.

2. The current distributing device of claim 1, wherein each of the three current conducting element is made through machined sheet welding the one or more single metal contained in that current conducting element.

3. The current distributing device of claim 1, wherein each of the three current conducting elements contains three conducting parts.

4. The current distributing device of claim 3, wherein at least two of the three conducting parts are identical to each other for each conducting element.

5. The current distributing device of claim 1, wherein the each of three current conducting elements goes through the center of the current distributing device.

6. The current distributing device of claim 1, wherein the first, the second, and the third current conducting elements are a live conductor, a neutral conductor, and a grounding conductor respectively.

7. The current distributing device of claim 6, wherein the live conductor and the neutral conductor are crossed over as to maintain polarity of the live conductor and the neutral conductor at opposite sides of the current distributing device.

8. The current distributing device of claim 6, wherein the neutral conductor contains only two conducting parts.

9. The current distributing device of claim 6, wherein each of the live conductor and the neutral conductor contains three conducting parts, and wherein at least two of the live conductor parts are in a same shape as that of at least two of the neutral conductor parts.

10. The current distributing device of claim 6, wherein the grounding conductor contains only two conducting parts.

11. The current distributing device of claim 1, wherein a portion of one of the first, the second, and the third current conducting element is removed to create space in the current distributing device for one or more power related features.

12. The current distributing device of claim 11, wherein the one or more power related features in the current distributing device include one of on/off switch, universal serial bus (USB) charger, battery, remote control receiver, Internet through power line, and surge protection.

13. The current distribution device of claim 11, wherein the portion is a half of one of the first, the second, and the third current conducting element.

14. The current distributing device of claim 1, where a portion of one of the first, the second, and the third current conducting element is removed to comply with national safety rules or regulations.

15. The current distributing device of claim 14, wherein the compliance with the national safety rules or regulation includes integration of a circuit breaker and a thermal switch.

16. The current distributing device of claim 1, wherein the three conducting element are enclosed in a non-metal enclosure.

17. The current distributing device of claim 1, wherein the current distributing device is a cubical socket having six sides.

18. The current distributing device of claim 17, wherein one of the six sides is connected to a power supply through one of a power plug and a power cable.

19. The current distributing device of claim 17, wherein one of the six sides includes a USB charging port.

20. The current distributing device of claim 17, wherein five of the six sides each contains a single power socket including a socket receptacle.

* * * * *